US010276139B1

(12) United States Patent
Pertchik

(10) Patent No.: US 10,276,139 B1
(45) Date of Patent: Apr. 30, 2019

(54) MUSICAL INSTRUMENT HAVING DIMINISHED CHORDS INTERLACED WITH OTHER CHORDS

(71) Applicant: Roy Pertchik, Lexington, MA (US)

(72) Inventor: Roy Pertchik, Lexington, MA (US)

( * ) Notice: Subject to any disclaimer, the term of this patent is extended or adjusted under 35 U.S.C. 154(b) by 0 days.

(21) Appl. No.: 15/709,952

(22) Filed: Sep. 20, 2017

Related U.S. Application Data

(60) Provisional application No. 62/408,236, filed on Oct. 14, 2016.

(51) Int. Cl.

| | |
|---|---|
| ***G10H 1/00*** | (2006.01) |
| ***G10H 1/34*** | (2006.01) |
| ***G10H 1/38*** | (2006.01) |
| ***G10H 1/18*** | (2006.01) |

(52) U.S. Cl.
CPC ..... *G10H 1/344* (2013.01); *G10H 1/0008* (2013.01); *G10H 1/38* (2013.01); *G10H 2210/601* (2013.01); *G10H 2220/096* (2013.01); *G10H 2220/251* (2013.01)

(58) Field of Classification Search
CPC .... G10H 1/38; G10H 1/383; G10H 2210/066; G10H 2210/601; G10H 2210/101; G10H 2210/571; G10H 2220/036; G09B 15/00; G10G 1/02; G10C 3/12; G10D 13/085
See application file for complete search history.

(56) References Cited

U.S. PATENT DOCUMENTS

| | | | | |
|---|---|---|---|---|
| 4,031,800 | A * | 6/1977 | Thompson | G10C 3/12 84/423 B |
| 5,741,990 | A * | 4/1998 | Davies | G09B 15/004 84/423 R |
| 6,566,593 | B2 | 5/2003 | Pertchik | |
| 9,620,093 | B2 * | 4/2017 | Velez-Gallego | G10H 1/34 |
| 2002/0029682 | A1 * | 3/2002 | Pertchik | G09B 15/02 84/477 R |
| 2002/0134223 | A1 * | 9/2002 | Wesley | G10H 1/0066 84/719 |
| 2007/0034070 | A1 * | 2/2007 | Hammond | G09B 15/02 84/477 R |
| 2009/0173212 | A1 * | 7/2009 | Wold | G09B 15/02 84/483.2 |
| 2011/0167987 | A1 * | 7/2011 | Lozano, Jr. | G09B 15/00 84/471 R |
| 2012/0031254 | A1 * | 2/2012 | Hotrique | G10C 3/12 84/423 R |
| 2012/0174735 | A1 * | 7/2012 | Little | G10H 1/0008 84/613 |
| 2014/0083279 | A1 * | 3/2014 | Little | G10H 1/0008 84/609 |
| 2014/0149911 | A1 * | 5/2014 | Lam | H04M 1/72522 715/771 |
| 2017/0330539 | A1 * | 11/2017 | Little | G10H 1/0008 |

* cited by examiner

*Primary Examiner* — Marlon T Fletcher
(74) *Attorney, Agent, or Firm* — Salter & Michaelson

(57) ABSTRACT

A musical instrument with two or more classes of pitches where at least one class is a diminished chord extended over an arbitrary number of octaves, and another class is another chord extended over the same span of octaves. The pitches of the second class of pitches are interlaced with the pitches of the diminished chord of the first class of pitches. Additional classes are chords similarly interlaced with other classes, with one class of any interlaced pair of classes being a diminished chord.

16 Claims, 1 Drawing Sheet

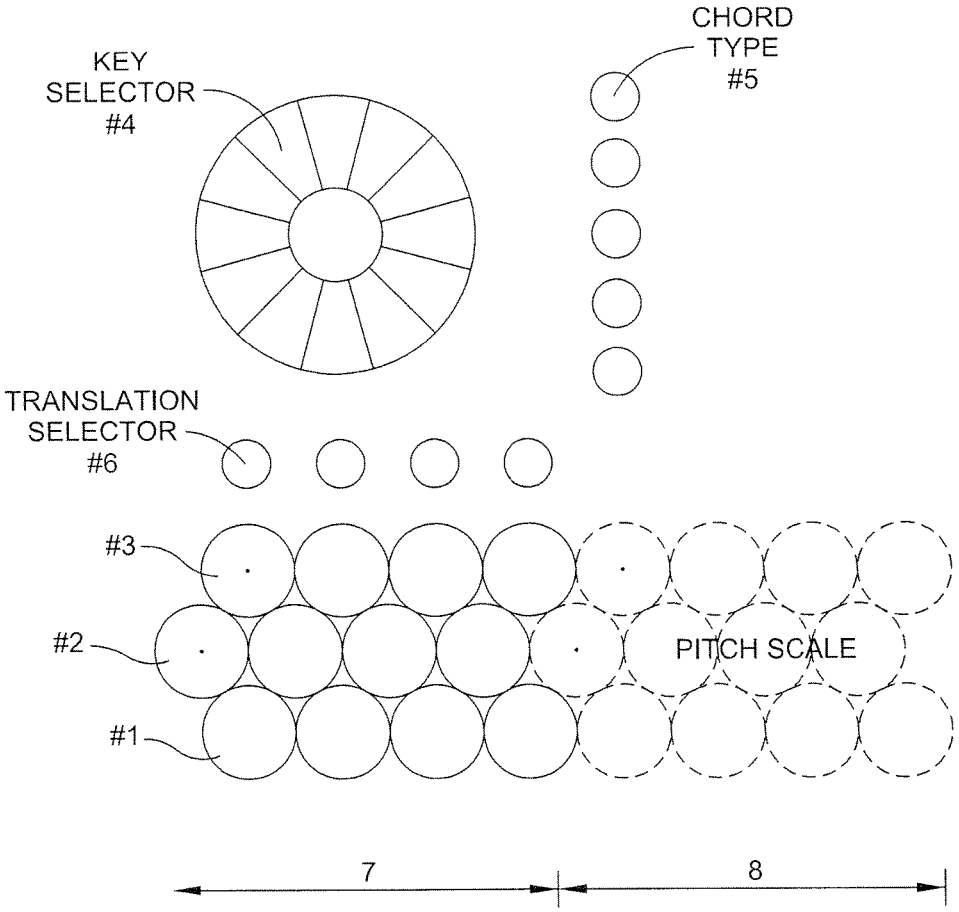
CHORD
TYPE
#5
KEY
SELECTOR
#4
TRANSLATION
SELECTOR
#6
#3
#2
#1
PITCH SCALE
7
8

MUSICAL INSTRUMENT HAVING DIMINISHED CHORDS INTERLACED WITH OTHER CHORDS

RELATED CASE

Priority for this application is hereby claimed under 35 U.S.C. § 119(e) to commonly owned and U.S. Provisional Patent Application No. 62/408,236 which was filed on Oct. 14, 2016 and which is incorporated by reference herein in its entirety.

FIELD OF THE INVENTION

The present invention relates to a musical instrument that presents the 12 pitches of traditional western music in a layout that differs from the layout of a traditional piano keyboard, offering simplified access to some kinds of musical harmony.

BACKGROUND AND SUMMARY OF THE INVENTION

There are a variety of musical instruments which present the player with musical pitch actuators laid out in an array for easy access. By far the most common of these prior art instruments are those that utilize the traditional piano keyboard layout. The traditional piano keyboard layout presents in two rows, actuators for the 12 musical pitches of traditional western music. One row includes actuators for the 7 pitches of the diatonic scale, typically the C Major scale, consisting of the musical pitches C, D, E, F, G, A, and B. The second row includes actuators for the 5 pitches referred to as "accidentals" or "sharps and flats," consisting of Gb, Ab, Bb, Db, and Eb, or as they are also sometimes called, depending on the context, F#, G#, A#, C#, and D#.

Further, with the traditional keyboard layout, the actuators for accidentals are interlaced between the actuators for the diatonic notes so that by moving laterally and alternating rows as needed, the musician can play all twelve pitches of traditional western music in sequence, or alternatively, play pitches belonging to the C Major scale with the actuators in one of the rows, or also alternatively play pitches among the accidentals with the actuators in the other row. The entire collection of 12 actuators in this arrangement is repeated laterally as needed in order to extend the range of the instrument over several octaves. One important feature of this arrangement is that it facilitates playing music written to exploit the natural or diatonic harmonies of the C Major scale. This is facilitated the segregation of the relevant actuators for the pitches of the C Major scale into one row, and relegating the actuators for the accidentals to a second row. Harmonies not available among the notes of the C Major scale can be played by "borrowing" actuators from the second row of accidentals, with some study being required to learn which actuators in the second row to use and when.

Other prior art alternative keyboard layouts present actuators in different arrangements for various benefits. For example, members of a class of keyboard layout designs sometimes called 6+6 keyboards, offer multiple rows of interlaced actuators segregated for "whole tone scales," ie. Janko keyboard, and the Tri-Chromatic keyboard. There are two possible whole tone scales, and each includes 6 pitches. One whole tone scale includes the pitches C, D, E, F#, G#, and A#. The other whole tone scale includes the pitches C#, D#, F, G, A, and B. The 6+6 keyboard designs segregate the pitch actuators for the members of the two whole tone scales into two rows. The 6+6 arrangement has greater symmetry than the traditional piano layout. The 6+6 arrangement is intended to facilitate musical transposition by presenting similar or identical ergonomics in all positions on the keyboard.

Other prior art keyboard designs include various button accordion designs, the modern Jammer keyboard, the Axis keyboard, and others, which present rectilinear or hexagonal arrays of actuators, arranged so that the resulting proximity of actuators facilitates playing various musical intervals, ie, 3rds, 4ths and 5ths, and again offering ergonomic consistency as well as easy access to useful harmonic relationships.

The present invention is intended to facilitate easy access to a kind of harmony not as easily accessed via prior art actuator layout arrangements. These harmonies are used notably in jazz as well as other kinds of music, in which the three diminished chords present in the traditional 12 pitch scale are used to transition between other chords. With the use of the actuator arrangement of this invention, a musician can access these harmonies much more easily and with little or no study, compared to the years of study needed to do so with previous actuator layout arrangements.

In accordance with the present invention there is provided a musical instrument with two or more classes of pitches where at least one class is a diminished chord extended over an arbitrary number of octaves, and another class is another chord extended over the same span of octaves, and whose pitches are interlaced with the pitches of the diminished chord of the first described class. Possible additional classes are chords similarly interlaced with other classes, with one class of any interlaced pair of classes being a diminished chord.

One embodiment of the present invention is where the classes of pitches are assigned to mechanical actuators arranged in groups by class, in which the activation of an actuator causes the production of a musical pitch within the class; where the actuators are in substantially parallel rows, in pitch ascending order; where the classes of pitches are assigned to actuators present on a touch sensitive display, the activation of each of which causes the production of a musical pitch within the class; where the actuators are in substantially parallel rows, in pitch ascending order; where additional controls are available for real time assignment of key, chord type, and translation of one or more classes of pitches; and where a computer algorithm selects members of the classes of pitches, which causes the production of a musical pitches.

Also the present invention relates to a musical instrument with two or more classes of pitches where at least one class is a diminished chord extended over an arbitrary number of octaves. More particularly the present invention relates to a musical instrument with two or more classes of pitches where at least one class is a diminished chord extended over an arbitrary number of octaves, and another class is another chord extended over the same span of octaves, the pitches of the second class being interlaced with the pitches of the first class.

DESCRIPTION OF THE DRAWINGS

The drawing forming part of this document illustrates this invention further, and the schematic embodiments of this invention and their description are used to explain this invention, but not restrict this invention. The drawing is a schematic diagram of actuators arranged in accordance with the present invention.

DETAILED DESCRIPTION

The present invention uses two or more classes of pitches which are disjoint, 4 member subsets of the traditional 12 pitch western musical scale, the particulars of the subsets (chords) being as defined below. In the favored embodiment the members of one class are assigned to a row of actuators, one pitch to an actuator, and the members of another class are similarly assigned to a second row of actuators, and so on for possible additional classes and rows of actuators.

At least one of the classes of pitches and the corresponding row of actuators, is assigned to the pitches of one of the three possible diminished chords found in a traditional 12 pitch scale (FIG. 1, #2);

1) The C diminished chord, consisting of the pitches C, Eb, Gb, A or

2) The Db diminished chord, consisting of the pitches Db, E, G, Bb or

3) The D diminished chord, consisting of the pitches D, F, Ab, B.

The diminished chords are repeated through an arbitrary number of octaves, forming a class of pitches or row of actuators of arbitrary length. (FIG. 1, #7 is the length of one octave. FIG. 1, #8 indicates a repeat of #7 an arbitrary number of times.)

A characteristic of a diminished chord as described above, is that each pair of adjacent pitches is separated by two pitches that are not a members of the diminished chord. Eg, in 1) C diminished (above,) between the pair of adjacent members of the diminished chord, C and Eb, are Db and D which are not members of the diminished chord. Between members Eb and Gb, are non-members E and F. Between members Gb and A, are nonmembers G and Ab. Note that when the C diminished is repeated over several octaves, at the repeat, between member A and member C are non-members Bb and B, so this property of two non-members existing between each pair of members, is consistent throughout a diminished chord which has been repeated to extend over a keyboard of arbitrary length. In common musical terminology, this separation of a pair of pitches by exactly two intervening pitches, is called an interval of a "minor $3^{rd}$," and so a diminished chord can be described as a series of minor $3^{rd's}$ An additional class of pitches or row of actuators (FIG. 1, #1) is assigned to the member pitches of one of the interlacable chords (see Table 1) such that the chords are created by using the following procedure; given a diminished chord as described above, select in one octave, one pitch from between each pair of adjacent pitches in the diminished chord, thereby generating a new 4 pitch chord who's pitches are interlaced between the diminished chord pitches, and which can then also be repeated to extend over a keyboard of arbitrary length. Following this procedure in every permutation, and then eliminating duplicates differing only in translation, produces exactly five possible chord types; Maj6, min6, Dominant7, Diminished, and Aug/Aug. The simplest embodiment of this invention includes two classes of pitches or rows of actuators, one class or row of which contains the pitches of a diminished chord and the other class or row of which contains a chord from among one of the five possible chord types that can be interlaced between the given diminished chord pitches.

This arrangement of pitches in two classes or actuators in two rows, facilitates playing harmonies used in jazz and other music. For example, if one chooses a D diminished chord for one class or row of actuators, and a C Maj6 chord for the other class or row, it is then easy to play CMaj6 by choosing pitches from the CMaj6 row, as the relevant pitches are segregated into one class or row. It is also easy to create common musical tension by playing pitches in the D diminished chord by choosing pitches in the other class or row. It is also easy to play "hybrid" harmonies by playing some notes from each class or row. It is a characteristic of this arrangement, that common musical sequences can be achieved by choosing pitches from alternating classes or rows, or combinations of pitches from both classes or rows. It is a characteristic of this arrangement that the musical sequences thus created, when the sequence first emphasizes more of the eg. D diminished notes and subsequently emphasizes more of the C Major6 notes, the sequence thus created will be commonly perceived as resolving in a satisfying musical way. Traditional music theory describes this perceived resolution in its simplest form, as a movement from V Dominant to I Major, or from III Dominant to VI minor.

In addition, other combinations of diminished chords interlaced with other interlacable chords, provide access to other common musical movements of traditional music theory. For example, in the context of the example above, with C Maj6 and D diminished assigned to two classes or rows of actuators, the additional assignment of F Maj6 interlaced with Db diminished to classes or rows of actuators, and then first playing F Maj6 pitches, then playing Db diminished pitches, then playing D diminished pitches, and finally playing C Maj6 pitches, creates cord movements of traditional music theory known as II minor to VI Dominant, to II minor, to V Dominant, to I Major. Extending this example further with the additional assignments of G Maj6 and C diminished to classes or rows of actuators, makes available VI minor to II Dominant movements, as well as a variety of I, IV, V progressions. Selections of other combinations of Diminished chords with other interlaced chords similarly creates in sum, access to a very wide range of chord movements found in traditional music theory and employed in jazz and other kinds of music, including tritone substitutions, minor $3^{rd}$ substitutions, deceptive cadences, and key modulations. These chord movements are achieved without the need to study the detailed pitch contents of the chords involved, thereby greatly simplifying the task of the aspiring musician.

In accord with this invention, it is possible to build physical instruments consisting of two or more rows of actuators for the pitches in the chords described above. In accord with this invention, it is possible to create computer algorithms that select and play notes from the classes of pitches in the chords as described above. In the favored embodiment, the two or more rows of actuators for pitches in chords as described above, are presented as rows of actuators on a touch sensitive screen, and may be provided with additional controls (FIG. 1, #4, key selector, #5, chord type selector, and #6, translation selector) that let the user assign in real time, the chord and pitch content of the rows of actuators, in accord with Table 1. Note that in the favored embodiment, two or three or more rows of actuators may be presented. Note that in Table 1, in addition to the five possible types of chords described above, we add for each chord type, the possible translations, resulting in 48 possibilities for four pitch chords that can be interlaced with a diminished chord. The assignment of pitches to actuators in accord with Table 1 is accomplished as follows; One of the three diminished chord is selected (1, 2, or 3 in Table 1, corresponding to D diminished, Eb diminished, or E diminished, respectively.) The pitches in the selected diminished chord are assigned to one row of actuators, (eg., FIG. 1, middle row (#2)). Then one of 5 chord types is selected compatible with the selected diminished, (a, b, c, d, e under each section 1, 2, or 3, corresponding to Major $6^{th}$, Minor $6^{th}$, Dominant $7^{th}$, Diminished, or Aug/Aug, respectively.) Finally, one of the possible translations listed under a, b, c, d, or e is selected and those pitches are assigned to the adjacent row of actuators (eg., FIG. 1, bottom row (#1)) For example, for the initial selection of a diminished chord, one might choose D diminished. In Table 1, Section 1 lists the pitches in D diminished as D, F, Ab, and B. These would be assigned to row #2 FIG. 1. In Table 1, section 1 (for D diminished) are 5 chord types, a, b, c, d, and e. One might choose b, a Minor $6^{th}$ chord type, and from this group, one might choose the first of the 4 available translations, C-min6. The pitches given for C-min6 are C, Eb, G, and A. These pitches would be assigned to row #1 FIG. 1. By making assignments of pitches to adjacent rows of actuators in accord with Table 1, thusly, one will create adjacent rows of pitch actuators in which a diminished chord is interlaced with another cord. Note that Table 1 contains all of the possible combinations of diminished chords interlaced with other four note chords, but that an instrument offering a subset of these combinations is an instrument in accord with this invention. With an instrument thus created, the player then touches actuators in the various rows on the screen to activate standard midi or other electronic commands, to sound various musical pitches.

Table 1: Table Showing all (48 Total) 4 Note Chords that can be Interlaced with the Three Diminished Chords 1) The chords that can be interlaced with a D diminished chord (D, F, Ab, B) are:

a. Major $6^{th}$ chords: C-Maj6 (C, E, G, A); Eb-Maj6 (Eb, G, Bb, C); Gb-Ma6 (Gb, Bb, Db, Eb); A-Maj6 (A, Db, E, Gb)
b. Minor $6^{th}$ chords: C-min6 (C, Eb, G, A); Eb-min6 (Eb, Gb, Bb, C); Gb-min6 (Gb, A, Db, Eb); A-min6 (A, C, E, Gb)
c. Dominant $7^{th}$ chords: C-Dom7 (C, E, G, Bb), Eb-Dom7 (Eb G, Bb Db); Gb-Dom7 (Gb, Bb, Db, E); A-Dom7 (A, Db, E, G)
d. Diminished chords: C-dim (C, Eb, Gb, A); Db-dim (Db, E, G, Bb)
e. Aug/Aug chords: C-Aug/Aug (C, E, Gb, Bb); Eb-Aug/Aug (Eb, G, A, Db)

2) The chords that can be interlaced with a Eb diminished chord (Eb, Gb, A, C) are:

a. Major chords: Db-Maj6 (Db, F, Ab, Bb); E-Maj6 (E, Ab, B, Db); G-Maj6 (G, B, D, E); Bb-Maj6 (Bb, D, F, G)
b. Minor chords: Db-min6 (Db, E, Ab, Bb); E-min6 (E, G, B, Db); G-min6 (G, Bb, D, E); Bb-min6 (Bb, Db, F, G)
c. Dominant $7^{th}$ chords: Db-Dom7 (Db, F, Ab, B); E-Dom7 (E, Ab, B, D); G-Dom7 (GB, D, F); Bb-Dom7 (Bb D, F, A)
d. Diminished chords: Db-dim (Db, E, G, Bb); D-dim (D, F, Ab, B)
e. Aug/Aug chords: Db-Aug/Aug (Db, F, G, B); E-Aug/Aug (E, Ab, Bb, D)

3) The chords that can be interlaced with a E diminished chord are:

a. Major $6^{th}$ chords: D-Maj6 (D, Gb, A, B); F-Maj6 (F, A, C, D); Ab-Maj6 (Ab, C, Eb, F); B-Maj6 (B, Eb, Gb, A)
b. Minor $6^{th}$ chords: D-min6 (D, F, A, B); F-min6 (F, Ab, C, D); Ab-min6 (Ab B, Eb, F); B-min6 (B, D, Gb, Ab)
c. Dominant $7^{th}$ chords: D-Dom7 (D, Gb, A, C); F-Dom7 (F, A, C, Eb); Ab-Dom7 (Ab, C, Eb, Gb); B-Dom7 (B, Eb, Gb, A)
d. Diminished chords: D-dim (D, F, Ab, B); Eb-dim (Eb, Gb, A, C)
e. Aug/Aug chords: D-Aug/Aug (D, Gb, Ab, C); F-Aug/Aug (F, A, B, Eb)

The above descriptions only relate to the preferred embodiments of this invention, and do not restrict this invention. All possible modifications, equivalent substitutions and improvements made based on the spirit and principle of this invention are included in the protective range of this invention.

What is claimed is:

1. A musical keyboard for generating tones, comprising:

a first register of keys for generating a first class of pitches including a diminished chord extending over an arbitrary number of octaves;

a second register of keys for generating a second class of pitches;

the pitches of the second class of pitches being interlaced with the pitches of the diminished chord of the first class of pitches;

wherein the classes of pitches are assigned to mechanical actuators arranged in groups by class, in which the activation of an actuator causes the production of a musical pitch within the mechanical actuators;

wherein the mechanical actuators are in substantially parallel rows and the keys of the first register are offset from the keys of the second register by half the spacing between adjacent keys of either register;

wherein 4 Note Chords that can be Interlaced with the Three Diminished Chords, as follows:

i) The chords that can be interlaced with a D diminished chord (D, F, Ab, B) are:

a. Major 6th chords: C-Maj6 (C, E, G,A); Eb-Maj6 (Eb, G, Bb, C);
Gb-Ma6 (Gb, Bb, Db, Eb); A-Maj6 (A, Db, E, Gb)
b. Minor 6th chords: C-min6 (C, Eb, G, A); Eb-min6 (Eb, Gb, Bb, C);
Gb-min6 (Gb, A, Db, Eb); A-min6 (A, C, E, Gb)
c. Dominant 7th chords: C-Dom7 (C, E, G, Bb), Eb-Dom7 (Eb G, Bb Db);
Gb-Dom7 (Gb, Bb, Db, E); A-Dom7 (A, Db, E, G)
d. Diminished chords: C-dim (C, Eb, Gb, A); Db-dim (Db, E, G, Bb)
e. Aug/Aug chords: C-Aug/Aug (C, E, Gb, Bb); Eb-Aug/Aug (Eb, G, A, Db)

ii) The chords that can be interlaced with a Eb diminished chord (Eb, Gb, A, C) are:

a. Major chords: Db-Maj6 (Db, F, Ab, Bb); E-Maj6 (E, Ab, B, Db);
G-Maj6 (G, B, D, E); Bb-Maj6 (Bb, D, F, G)
b. Minor chords: Db-min6 (Db, E, Ab, Bb); E-min6 (E, G, B, Db);
G-min6 (G, Bb, D, E); Bb-min6 (Bb, Db, F, G)
c. Dominant 7th chords: Db-Dom7 (Db, F, Ab, B); E-Dom7 (E, Ab, B, D);
G-Dom7 (GB, D, F); Bb-Dom7 (Bb D, F, A)
d. Diminished chords: Db-dim (Db, E, G, Bb); D-dim (D, F, Ab, B)

e. Aug/Aug chords: Db-Aug/Aug (Db, F, G, B); E-Aug/Aug (E, Ab, Bb, D)

iii) The chords that can be interlaced with a E diminished chord are:

a. Major 6th chords: D-Maj6 (D, Gb, A, B); F-Maj6 (F, A, C, D);
Ab-Maj6 (Ab, C, Eb, F); B-Maj6 (B, Eb, Gb, A)

b. Minor 6th chords: D-min6 (D, F, A, B); F-min6 (F, Ab, C, D);
Ab-min6 (Ab B, Eb, F); B-min6 (B, D, Gb, Ab)

c. Dominant 7th chords: D-Dom7 (D, Gb, A, C); F-Dom7 (F, A, C, Eb);
Ab-Dom7 (Ab, C, Eb, Gb); B-Dom7 (B, Eb, Gb, A)

d. Diminished chords: D-dim (D, F, Ab, B); Eb-dim (Eb, Gb, A, C)

e. Aug/Aug chords: D-Aug/Aug (D, Gb, Ab, C); F-Aug/Aug (F, A, B, Eb).

2. The musical keyboard of claim 1 wherein additional classes are chords similarly interlaced with other classes, with one class of any interlaced pair of classes being a diminished chord.

3. The musical keyboard of claim 1 wherein the classes of pitches are assigned to mechanical actuators arranged in groups by class, in which the activation of an actuator causes the production of a musical pitch within the class.

4. The musical keyboard of claim 3 wherein the actuators are in substantially parallel rows, in pitch ascending order.

5. The musical keyboard of claim 1 wherein the classes of pitches are assigned to actuators present on a touch sensitive display, the activation of each of which causes the production of a musical pitch within the class.

6. The musical keyboard of claim 5 wherein the actuators are in substantially parallel rows, in pitch ascending order.

7. The musical keyboard of claim 5 wherein additional controls are available for real time assignment of key, chord type, and translation of one or more classes of pitches.

8. The musical keyboard of claim 1 wherein a computer algorithm selects members of the classes of pitches, which causes the production of a musical pitches.

9. The musical keyboard of claim 1 wherein there is provided a third register representing a third horizontal row of actuators that is parallel to the first register.

10. The musical keyboard of claim 9 wherein the classes of pitches are assigned to actuators present on a touch sensitive display, the activation of each of which causes the production of a musical pitch within the class, and wherein the actuators in all rows are in substantially horizontal parallel configuration.

11. The musical keyboard of claim 1 wherein the second register includes sequential notes that form respective Maj6th, Minor6th, Dominant $7^{th}$, Diminished, and Aug/Aug chords.

12. The musical keyboard of claim 11 wherein the first register includes sequential notes that form a diminished chord.

13. The musical keyboard of claim 12 wherein the diminished chords are comprised of diminished chords "D"; "Eb" and "E".

14. The musical keyboard of claim 13 wherein there are four notes for each diminished chord comprised of "D"; "F"; "Ab"; "B" for diminished chord "D: "Eb"; "Gb"; "A"; "C" for diminished chord "Eb": and "E"; "G"; "Bb"; "Db" for diminished chord "E".

15. The musical keyboard of claim 14 wherein for the Maj6th, Minor6th, Dominant $7^{th}$, Diminished, and Aug/Aug chords there are a total of 48 different note combinations related to each diminished chord.

16. The musical keyboard of claim 13 wherein the notes of the first register include at least four diminished notes that are respectively spaced apart, wherein the notes of the second register include noted selected from respective Maj6th, Minor6th, Dominant $7^{th}$, Diminished, and Aug/Aug chords, and wherein the keys of the second register are offset from the keys of the first register by half the spacing between adjacent keys of the first register.

* * * * *